United States Patent [19]

Focke et al.

[11] Patent Number: 4,955,948

[45] Date of Patent: Sep. 11, 1990

[54] PROCESS AND APPARATUS FOR THE CHECKING OF CIGARETTES

[75] Inventors: Heinz Focke; Josef Schulte, both of Verden, Fed. Rep. of Germany

[73] Assignee: Focke & Co. (GmbH & Co.), Verden, Fed. Rep. of Germany

[21] Appl. No.: 373,840

[22] Filed: Jun. 29, 1989

[30] Foreign Application Priority Data

Jul. 4, 1988 [DE] Fed. Rep. of Germany ..... 3822520

[51] Int. Cl.[5] ..... A24C 5/34

[52] U.S. Cl. ..... 131/280; 131/905; 131/908; 209/536; 250/223 R

[58] Field of Search ..... 131/280, 282, 905, 907, 131/908, 910; 209/536, 579; 250/223 R; 73/865.8, 866

[56] References Cited

U.S. PATENT DOCUMENTS

| | | | |
|---|---|---|---|
| 3,557,374 | 1/1971 | Schmermund | 131/908 X |
| 4,266,674 | 5/1981 | Bell et al. | 209/536 |
| 4,486,098 | 12/1984 | Buchegger et al. | 209/536 X |
| 4,644,150 | 2/1987 | Kuga et al. | 209/536 |

FOREIGN PATENT DOCUMENTS

| | | |
|---|---|---|
| 0110125 | 6/1984 | European Pat. Off. . |
| 0157087 | 1/1985 | European Pat. Off. . |
| 1532268 | 11/1971 | Fed. Rep. of Germany . |
| 3243204 | 5/1984 | Fed. Rep. of Germany . |
| 3640491 | 6/1988 | Fed. Rep. of Germany . |
| 2527547 | 5/1983 | France . |

*Primary Examiner*—V. Millin
*Assistant Examiner*—J. L. Doyle
*Attorney, Agent, or Firm*—Sughrue, Mion, Zinn, Macpeak & Seas

[57] ABSTRACT

For the checking of cigarettes for their correct formation in terms of a sufficient tobacco content, electrooptical test processes have been employed for a relatively long time. The use of these processes has hitherto made it necessary to employ high-performance sensitive sensors in order to obtain definite test results. The new process and the corresponding apparatus are intended to make it possible to check cigarettes by the reflection process, especially in a cigarette conveyor (cigarette turret), in which accurate results can be obtained in short test times by means of a simple test device. By means of a special arrangement of the electrooptical sensors for the checking of the cigarettes in test units moved relative to the cigarettes to be checked, it is possible for the cigarettes to be checked for a correct tobacco content, by contactless sensing, either during stationary phases or during rotational movement of the cigarette conveyor (cigarette turret). At the same time, the high reflecting capacity of cigarette paper is utilized for checking the tobacco content.

16 Claims, 6 Drawing Sheets

PROCESS AND APPARATUS FOR THE CHECKING OF CIGARETTES

BACKGROUND OF THE INVENTION

The invention relates to a process for the checking of cigarettes for the correct formation of these at their ends by means of electrooptical sensors which possess transmitters and receivers and by means of which a test beam (light beam) is directed onto at least one end (end face) of the cigarettes and reflected light is measured. The invention relates, furthermore, to an apparatus for the checking of cigarettes.

Cigarettes are tested in conjunction with the packaging of these; for this, the cigarettes are checked for a correct sufficient tobacco content by electrooptical sensors.

The testing of cigarettes by electrooptical sensors is basically known. The processes adopted hitherto work either on the transmitted-light principle or on the reflection principle. The transmitted-light principle requires high-performance sensors which also have to be sensitive enough to react even to only slight differences in brightness. The reflection process can be used for the checking of cigarettes sometimes only at a high outlay. Because of the unfavourable reflecting properties of tobacco, test methods based on the reflecting properties of the tobacco can also only be employed in conjunction with high-performance sensors.

SUMMARY OF THE INVENTION

The object on which the invention is based is, therefore, to provide a process for the checking of cigarettes by means of electrooptical sensors, which works on the reflection principle, but nevertheless gives accurate results in the check for a sufficient tobacco content in very short test times.

To achieve this object, the process according to the invention is characterized in that the test beam is directed onto the end face of the cigarette at an acute angle, especially at an angle of less than 45°, in such a way that, when tobacco is missing in the region of this, light is reflected by cigarette paper.

In the process according to the invention, when there is a deficient tobacco content at a cigarette end, the test beam striking an inner face of the cigarette paper at an acute angle is reflected back and recorded by the receiver arranged concentrically relative to the transmitter. This process therefore utilizes the favourable reflecting properties of paper in order to check the cigarette ends for a sufficient tobacco content.

For the checking of one cigarette, there are preferably two sensors which are located opposite one another over the circumference and which form a sensor pair. For the checking of several cigarettes arranged in a row, the sensors, especially the sensor pair, are moved relative to the cigarettes, the end faces of the cigarettes being sensed by the test beams. The checking of the cigarettes of a cigarette group takes place in several part groups, the cigarettes of each part group being checked simultaneously.

The check can be carried out either during the stationary phases of a cigarette turret or during the movement of this. A check of the cigarettes of a cigarette group during the stationary phases takes place in two successive test stations, every second cigarette of all the rows of each cigarette group being checked by a test unit. In the check during the movement of the cigarette turret, all the cigarettes of a cigarette group, divided into several part groups, are checked in succession.

The apparatus for the checking of cigarettes according to the abovementioned process consists essentially of a test unit formed from several sensors which, combined to form sensor pairs, are arranged in a sensor carrier, specifically in such a way that the individual sensors form an angle smaller than 45° relative to the end faces of the cigarettes. The sensor pairs are respectively arranged on the sensor carrier of the test unit parallel to one another and at a distance from one another corresponding to two oblique rows of the cigarette group.

In an exemplary embodiment of the apparatus, for the checking of cigarette groups in an intermittently rotatable cigarette turret there are two test units. These are movable past the end faces of the cigarettes in two successive test stations during the stationary phases of the cigarette turret, in such a way that the sensor pairs are movable to and fro parallel to the alignment of the oblique rows. For the checking of the cigarettes, the two test units each have four sensor pairs. Every second cigarette of all the rows of a cigarette group is checked in each of the test stations. The to-and-fro movement of the test units takes place by means of a rack mechanism.

In a further advantageous exemplary embodiment of the apparatus for the checking of cigarettes, the check is made during the rotational movement of the cigarette turret. For this purpose, a test unit is movable in a plane parallel to the end faces of the cigarettes biaxially, specifically axially transversely relative to the longitudinal axes of the cigarettes. For the checking of all the cigarettes of a cigarette group by means of a test unit, the test unit has three sensor pairs. The biaxial movement of the test unit in the plane parallel to the end faces of the cigarettes is executed by means of a pivoting mechanism. A further feature of the invention relates to the design of the pivoting mechanism.

Two exemplary embodiments of the invention are explained in detail below by means of the drawings. In these:

DETAILED DESCRIPTION OF PREFERRED EMBODIMENTS

The procedure here involves the checking of the end regions of cigarettes. During the manufacture of cigarettes, defective cigarettes occur relatively frequently for production reasons. These defective cigarettes have to be sorted out with the least possible influence on the production cycle. This presupposes the installation of devices which are capable of identifying defective cigarettes and of generating a corresponding error signal leading to the ejection of the defective cigarettes.

Figure 1:
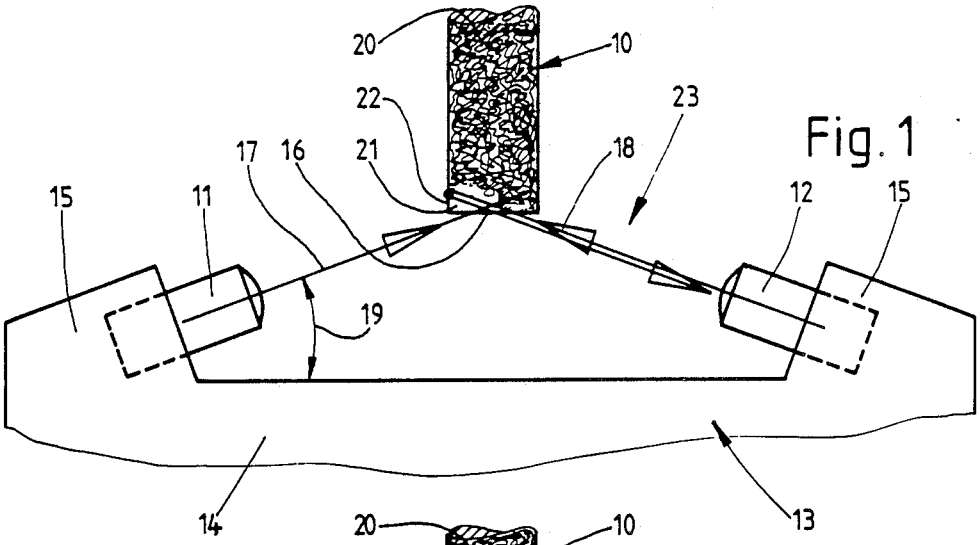
FIG. 1 shows a test unit with a cigarette, the defect of which extends over half the diameter of the cigarette.
Figure 2:
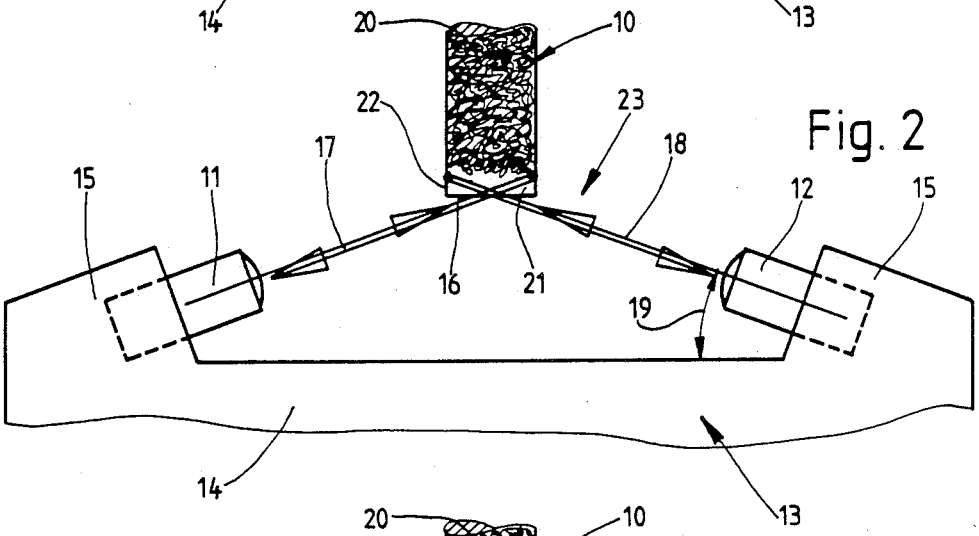
FIG. 2 shows the test unit with a cigarette, the defect of which extends over the entire diameter of the cigarette.
Figure 3:
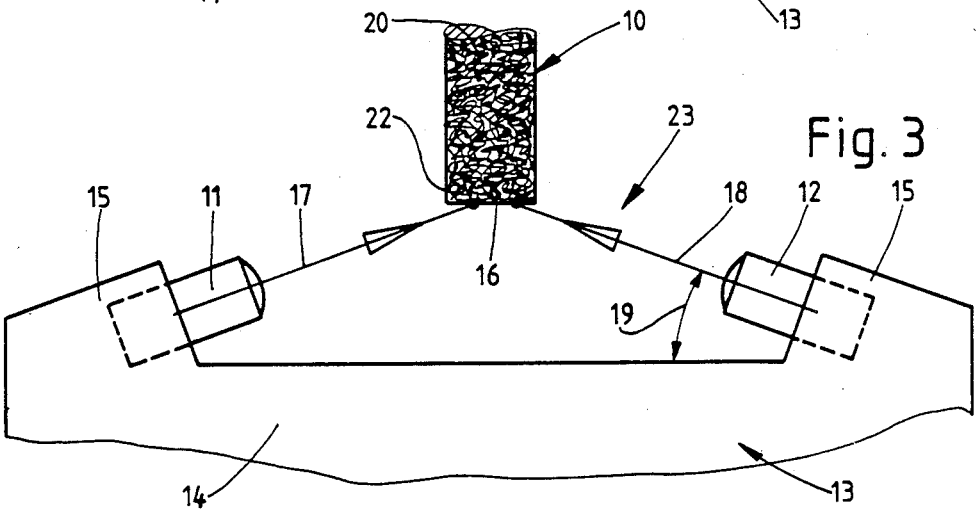
FIG. 3 shows the test unit with an intact cigarette.

In this particular case, electrooptical sensors 11, 12, in which a transmitter part and a receiver part are incorporated, are provided for defect identification and for emitting an error signal. FIG. 1 shows, as the simplest arrangement, a test unit 13 consisting essentially of a sensor carrier 14 which receives a sensor 11, 12 in an oblique socket 15 in each of its lateral end regions. The cigarette 10 to be checked is arranged centrally between the two sensors 11, 12 and is located with its end face 16 at such a distance from the sensor carrier 14 that the test beams 17, 18 originating from the sensors 11, 12 strike the end face 16 of the cigarette 10 at an acute angle 19. In the particular case, the angle 19 amounts to 20°. Because the test beams 17, 18 enter the end region of the cigarette 10 at an acute angle, one or both test beams 17, 18 strike the inner face of cigarette paper 22 wrapping the tobacco 20, depending on the size of a defect 21 occurring when tobacco 20 is missing. At least some of a test beam 17, 18 is reflected back and thus reaches the receiver of the sensor 11, 12. The sensor 11, 12 then generates a corresponding error signal.

If the cigarette 10 is formed correctly in its end region, that is to say if there is a complete tobacco content in the region of the end face 16, the test beams 17, 18 are absorbed by the tobacco 20, so that there is no error signal.

The striking of the end face 16 of a cigarette 10 by the test beams 17, 18 at the acute angle 19 makes it possible to detect even relatively small defects 21. Since defects 21 have edge regions which terminate relatively flat and which take up a large region of the end face 16, two sensors 11, 12 combined to form a sensor pair 23 are usually sufficient to identify defects 21 in the region of the end face 16 with sufficient reliability.

The above-described testing of individual cigarettes 10 can take place during the standstill or the movement of the cigarettes 10, and the test unit 13 can wait in the position of rest or is moved. The only criterion is that at a particular moment in a relative movement between a cigarette 10 and the test unit 13 or the sensor pair 23 the test beams 17, 18 can strike the end face 16 of the cigarette 10 to be checked, in the way described above.

Figure 4:
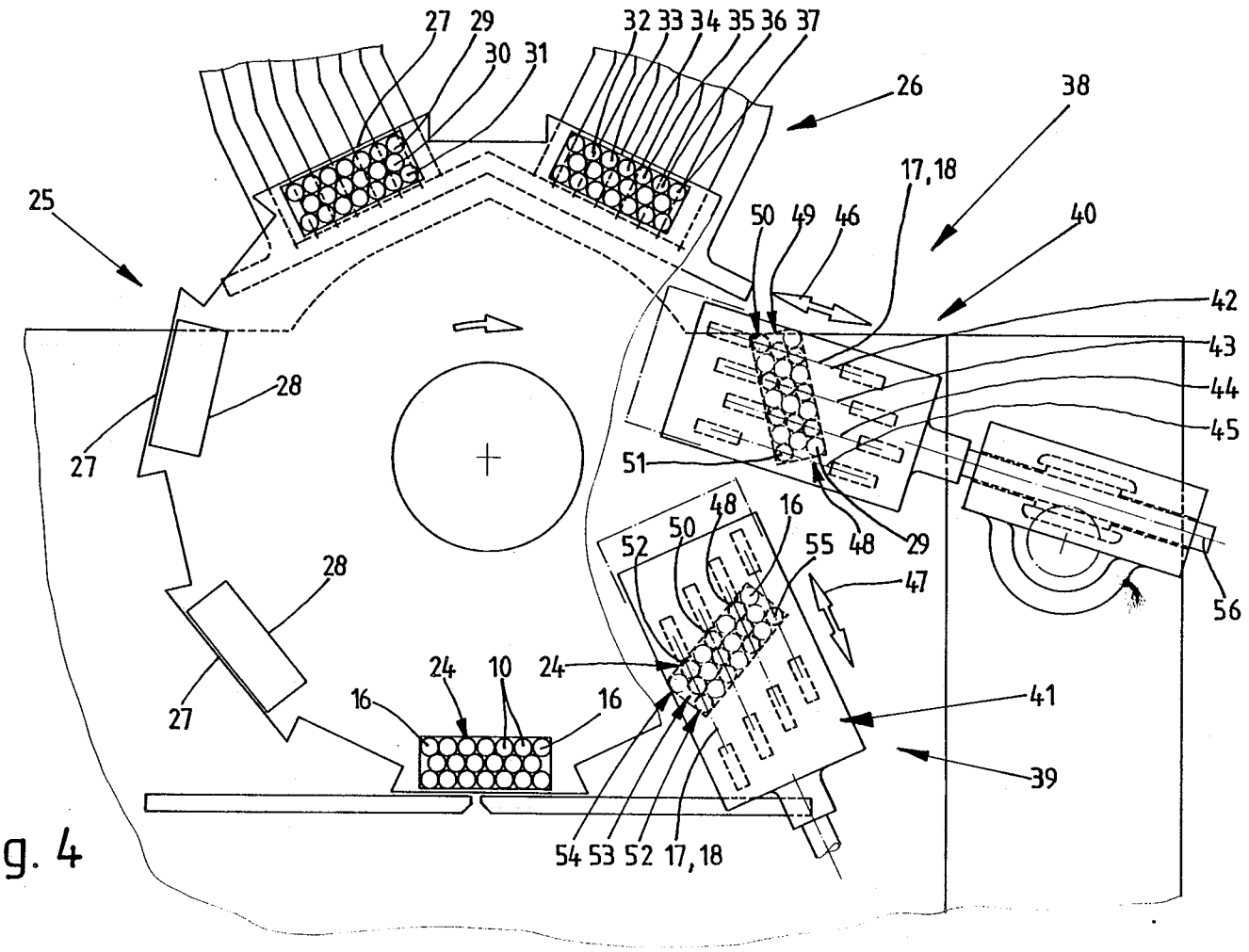
FIG. 4 shows a diagrammatic side view of a conveyor for cigarette groups, particularly a cigarette turret, with test units for the checking of the cigarettes.
Figure 5:
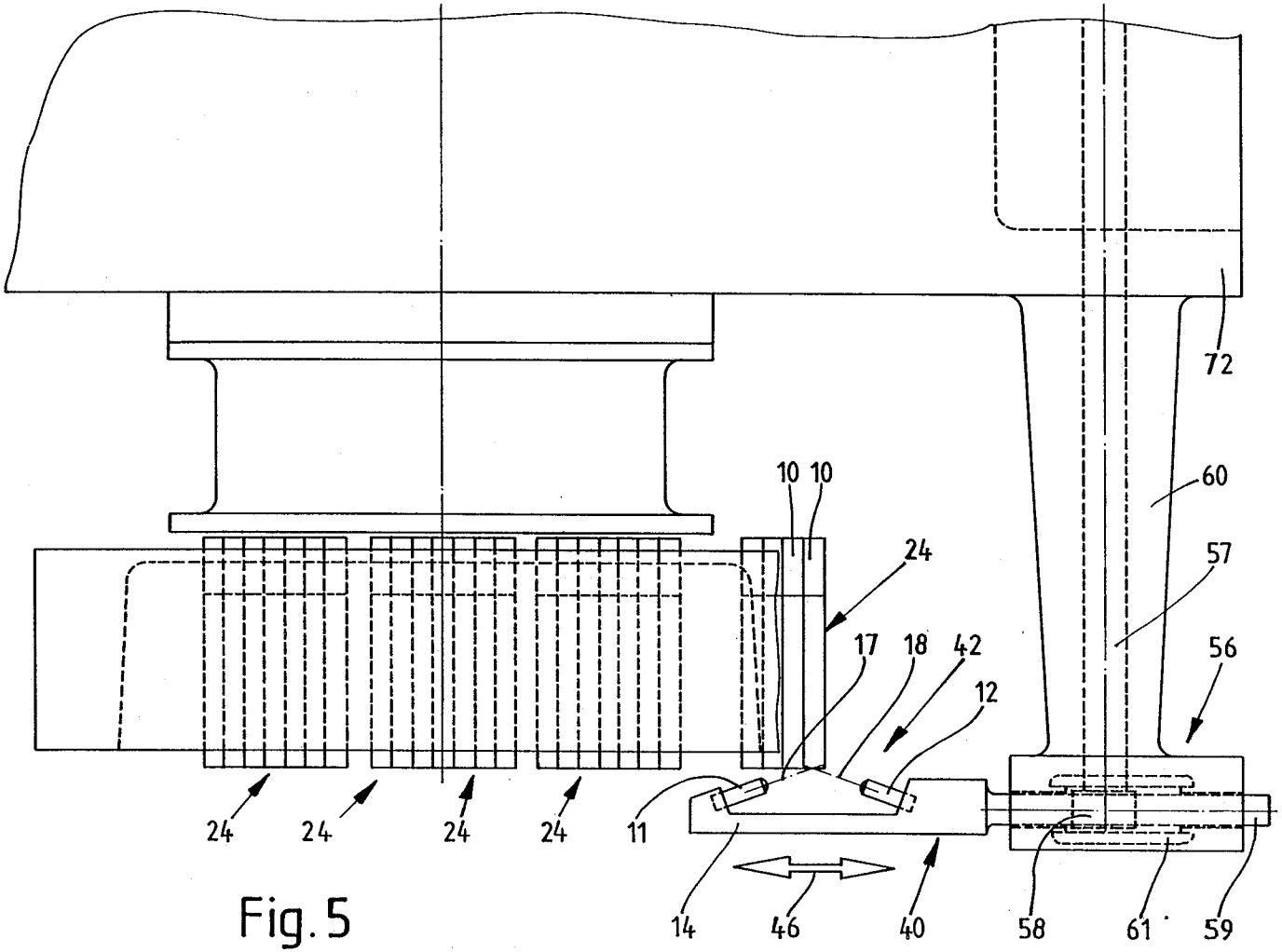
FIG. 5 shows a top view of the cigarette turret according to FIG. 4.
Figure 6:
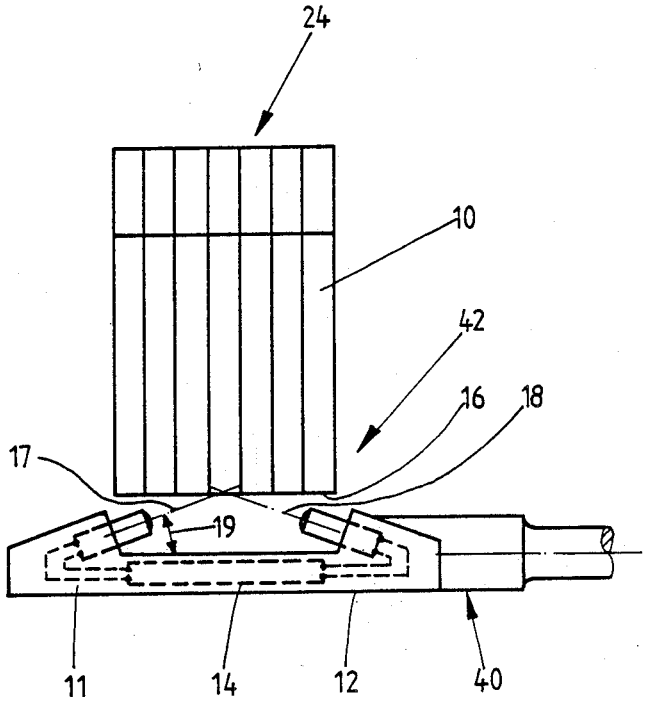
FIG. 6 shows the testing of a cigarette group.

The process described and the apparatus also make it possible to check cigarettes 10 in cigarette groups 24. The exemplary embodiment illustrated in FIG. 4 shows the checking of cigarettes 10 in conjunction with the packaging of these. Shown here is a cigarette turret 25 which is intermittently rotatable in a vertical plane after a cigarette magazine 26 of a packaging machine. The cigarette turret 25 is equipped with a plurality of pockets 27 over its circumference.

The cigarettes 10 are extracted from the cigarette magazine 26 by slides in a known way and are fed in the longitudinal direction, thereby respectively forming a cigarette group 24, to the cigarette turret 25, particularly pockets 27 located in the upper region. In the present case, the two upper obliquely directed pockets 27 are appropriately each filled with a cigarette group 24 simultaneously. The cigarette turret 25 is thereafter advanced a division corresponding to a pocket 27.

The cigarette groups 24 consist of several rows 29, 30, 31 extending along a pocket wall 28. Within these rows 29 to 31, the cigarettes 10 are in a close-packed position. In the present exemplary embodiment, the cigarettes 10 of adjacent rows 29 to 31 are arranged offset relative to one another (saddle position), so that the cigarettes 10 are arranged in line with one another both in the rows 29 to 31 and in oblique rows 32, 33, 34, 35, 36 and 37.

As a result of the rotation of the cigarette turret 25, the cigarette groups 24 so formed pass initially into a first test station 38 and thereafter into a second test station 39. Each test station 38, 39 is equipped with a test unit 40, 41. When, as with filterless cigarettes 10, both free ends of the cigarettes 10 have to be checked, further test units (not shown here) are arranged on the opposite side of the cigarette turret 25.

The test units 40, 41 are equipped with four sensor pairs 42, 43, 44 and 45 and are moved passed the end faces 16 of the cigarettes 10 in the direction of double arrows 46, 47.

The method by which the cigarettes 10 of the cigarette group 24 are checked in two successive test stations 38, 39 can be taken from FIG. 4. During the checking of the cigarettes 10, the test units 40, 41 execute a stroke movement indicated by the double arrows 46, 47, specifically in such a way that, in each stationary phase of the cigarette turret 25, a movement in the opposite direction relative to the preceding stationary phase is executed. FIG. 4 shows the position of the test units 40, 41 at the start of a check of the cigarettes 10. In each test station 38, 39, the cigarettes 10 are tested in three part groups 48, 49 and 50, the cigarettes 10 of each part group being checked simultaneously by means of a sensor pair 42 to 45. In this way, initially every second cigarette of the row 29 and an individual cigarette 51, which together form the part group 48, are checked simultaneously by the sensor pairs 42, 43, 44 and 45 in the test station 38. As a result of the continuous movement of the test unit 40 in the direction of the cigarette turret 25, next every second cigarette 10 of the row 30, particularly the part group 49, is checked by the sensor pairs 42, 43 and 44. The last part group 50 in the test station 38 is formed from every second cigarette 10 of the row 31, with the exception of the individual cigarette 51. The cigarettes 10 of this part group 50 are checked by the sensor pairs 42, 43 and 44. The cigarettes 10 in the test station 39 are checked in a similar way. Here, the cigarettes 10 of the respective part groups 52, 53 and 54 are checked in succession, the first part group 52 being composed of every second cigarette 10 of the row 29, including an individual cigarette 55. All the sensor pairs 42, 43, 44 and 45 of the test unit 41 are required for the checking of the part group 52. The part groups 53 and 54 are checked by means of the sensor pairs 43, 44 and 45.

Because the cigarettes 10 of the rows 29, 30 and 31 are arranged in a saddle position, the cigarettes 10 of every second oblique row 32, 34 and 36 and the individual cigarette 51 are checked in the test station 38 and the cigarettes 10 of every second oblique row 33, 35 and 37 and the individual cigarette 55 are checked in the test station 39.

For the checking of the cigarettes 10 arranged in the oblique rows 32 to 37 and of the individual cigarettes 51 and 55, the sensor pairs 42 to 45 of the test units 40, 41 are arranged at a distance from one another corresponding to two oblique rows 32 to 37 and offset respectively relative to one another. This ensures that, at a particular moment in the movement of the test units 40, 41 past the end faces 16 of the cigarettes 10, the respective end faces 16 of the cigarettes belonging to a part group 48 to 50 or 52 to 54 are checked simultaneously.

The to-and-fro movement of the test units 40, 41 is executed by means of a rack mechanism 56 which is driven by the drive unit (not shown) of the cigarette turret 25 in synchronism with the timing sequence of the latter. In particular, the drive is obtained by means of a pinion 58 which is located on a drive shaft 57 and which acts on a rack 59 connected firmly to the test unit 40, 41. For guiding the rack 59, a sliding guide 61 is provided in a housing jib 60 which also receives the entire rack mechanism 56.

Figure 7:
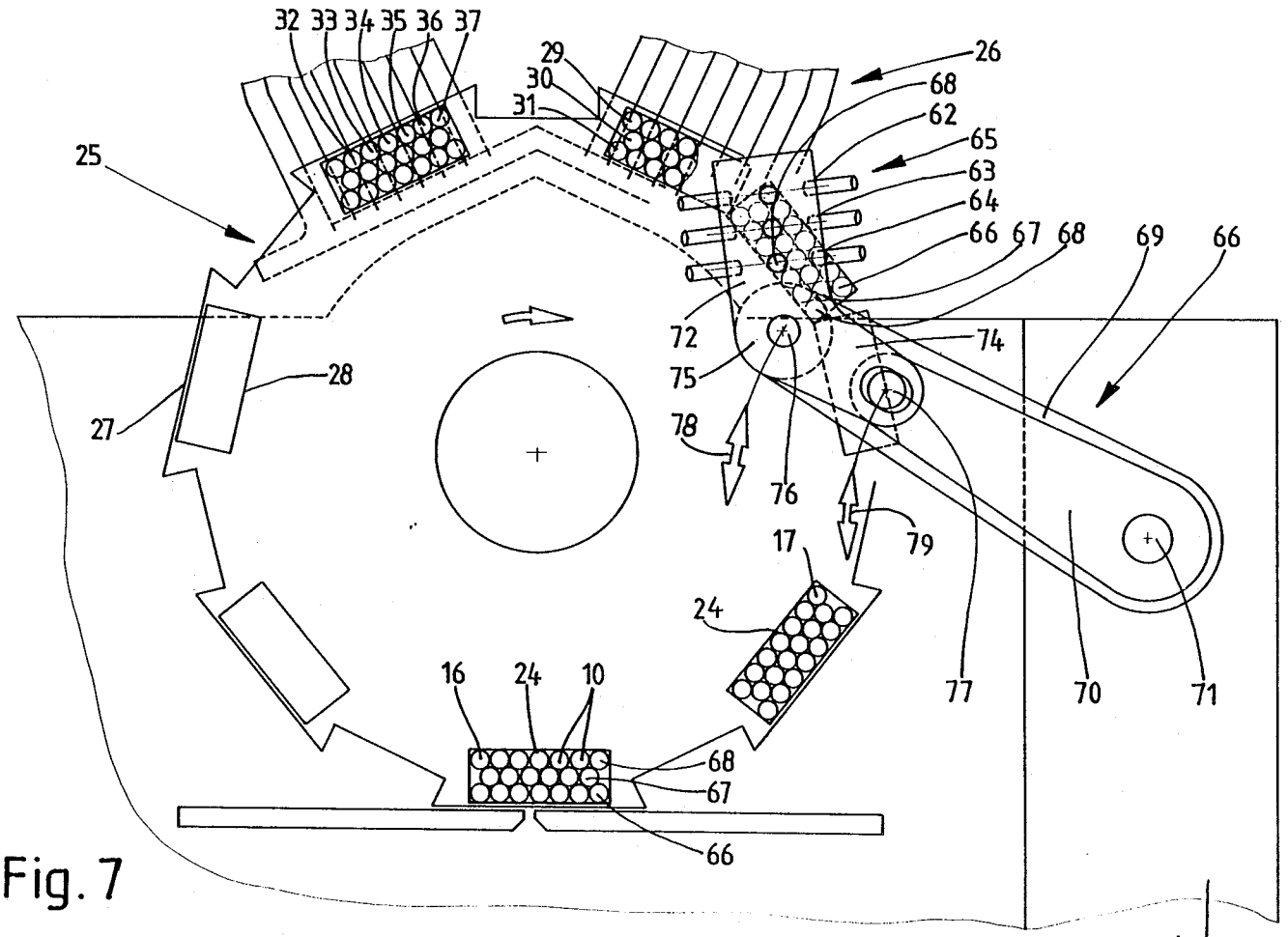
FIG. 7 shows a diagrammatic side view of a cigarette turret with a test unit.

A further exemplary embodiment of the apparatus is shown in FIG. 7. In contrast to the abovementioned exemplary embodiment, here the checking of the cigarettes 10 in the cigarette turret 25 takes place during the movement of the latter. Thus, a test unit 65 equipped with three sensor pairs 62, 63 and 64 is moved axially transversely relative to the longitudinal axes of the cigarettes 10 by means of a pivoting mechanism 66.

Figure 8:
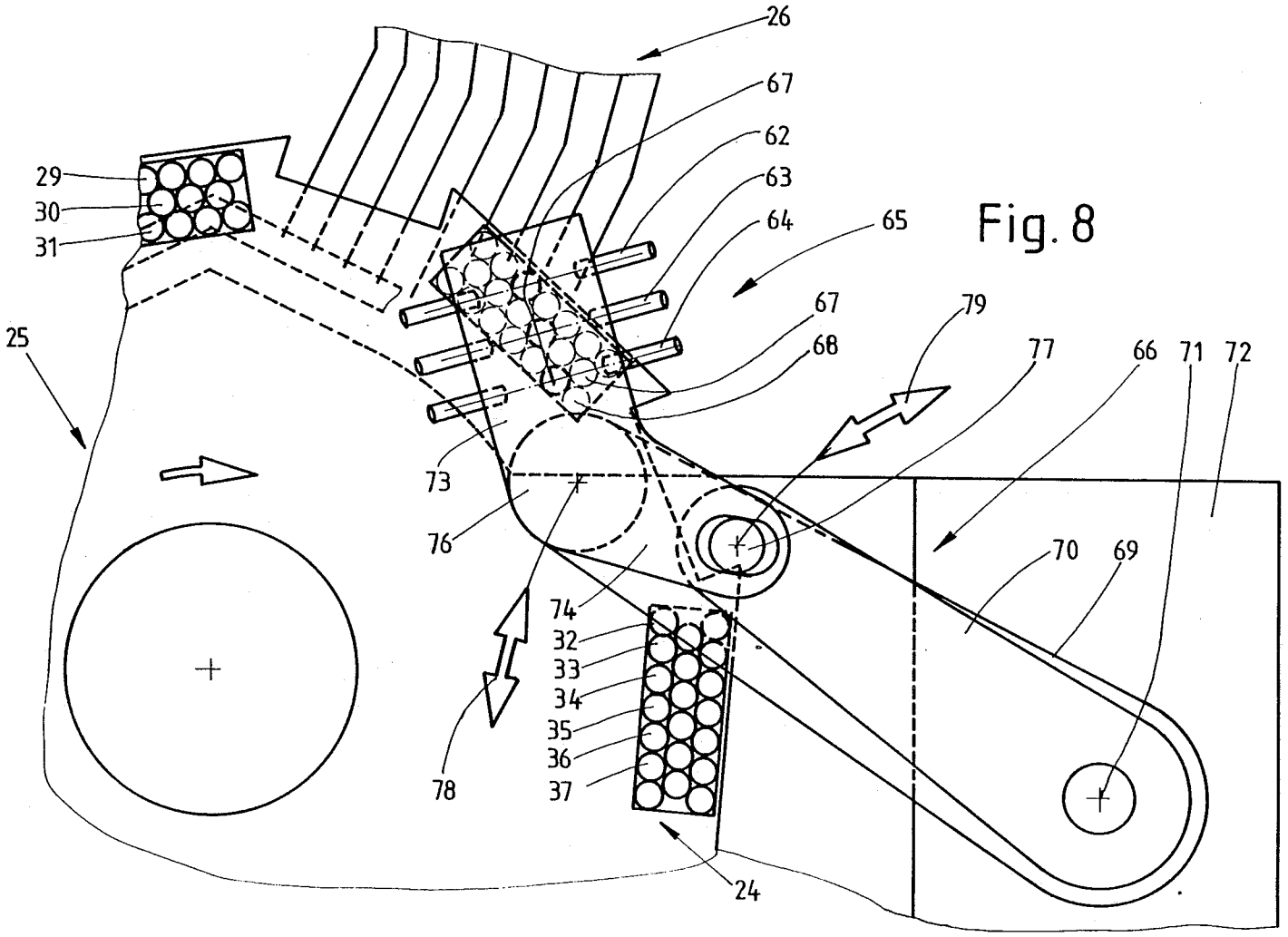
FIG. 8 shows an enlargement of a cutout from FIG. 7.

FIGS. 8 and 7 illustrate, in the order mentioned, two successive states of the relative movement between the test unit 65 and a cigarette group 24. FIG. 8 shows the test unit 65 with the sensor pairs 62, 63 and 64 which are arranged parallel to, and at a distance of two oblique rows 32 to 37, from one another and which are arranged without any lateral offset relative to one another. The cigarettes, each checked simultaneously by a sensor pair 62 to 64, are arranged in a part group 67. This part group 67 is formed from a cigarette 10 of each of the rows 29, 30 and 31, the end faces 16 of the cigarette 10 being arranged in a straight line, specifically at a distance from one another corresponding to two oblique rows 32 to 37. FIG. 7 shows the test unit 65 during the checking of a part group 68 following next during the rotational movement of the cigarette turret 25. During the checking of the cigarettes 10 of the cigarette group 24, a row 29, 30, 31 is assigned to each sensor pair 62, 63, 64 in the order mentioned.

The checking of the cigarettes 10 during the rotational movement of the cigarette turret 25 requires a biaxial pivoting of the test unit 65. For this purpose, the pivoting mechanism 66 is formed essentially from a supporting lever 69 and a pivoting lever 70 which are each articulated at one end in a common pivot bearing 71 on a machine stand 72 of the packaging machine.

The test unit 65 consists of a sensor carrier 73 receiving the sensor pairs 62 to 64, with a pivoting extension 74 projecting laterally from this. In a transitional region 75 to the pivoting extension 74 and at the free end of the pivoting extension 74, the test unit 65 is connected in an articulated manner to the other end of the supporting lever 69 and of the pivoting lever 70. At the same time, the connection between the test unit 65 and the supporting lever 69 is made via a rotary joint 76 and the coupling between the pivoting extension 74 of the test unit 65 and the pivoting lever 70 is made via a combined rotary sliding joint 77.

This des'gn of the pivoting mechanism 66 makes it possible for the test unit 65 to execute a pivoting movement about the pivot bearing 71 via the supporting lever 69. Superposed on this pivoting movement is a deflection of the pivoting lever 70 likewise mounted in the pivot bearing 71 and connected to the pivoting extension 74 of the test unit 65 via the rotary sliding joint 77, causing a pivoting movement of the test unit 65 in the rotary joint 76. The deflections of the supporting lever 69 and of the pivoting lever 70 about the pivot bearing 71 are indicated by double arrows 78 and 79 respectively.

Of course, the checking of cigarettes 10 by the process explained in detail here is not tied to a specific formation of the cigarette groups 24 in the cigarette turret 25. By appropriate changes of the distances between the sensor pairs 42 to 45 or 62 to 64 and/or a change of the number of sensor pairs 42 to 45 and 62 to 64 on a test unit 40, 41 and 65, cigarettes 10 can be checked in any possible formation of the cigarette groups 24.

What is claimed is:

1. Process for the checking of cigarettes, in the form of tobacco wrapped in cigarette paper, for correct formation of the cigarettes at their ends by means of electrooptical sensors, which possess transmitters and receivers, and by means for directing test light beams onto at least one end face of the cigarettes and measuring reflecting light, said process being characterized by directing the test light beams (17, 18) onto the end face (16) of a cigarette (10) at an acute angle (19) of less than 45° and in such a way that, when tobacco (20) is missing in a region of the cigarette (10), light is reflected by the cigarette paper (22).

2. Process according to claim 1, characterized by checking the cigarette (10) by means of at least two mutually opposite sensors (11, 12) which are distributed around the circumference of the cigarette (10) and which form a sensor pair (23).

3. Process according to claim 2, characterized by moving the sensors (11, 12) relative to the cigarette (10) and sensing an end face (16) thereof by the test light beams (17, 18).

4. Process according to claim 1, wherein the cigarettes are arranged in a plurality of cigarette groups, each said cigarette group comprising a plurality of part groups, said process characterized by successively checking the part groups (48, 49, 50; 52, 53, 54; 67, 68) of each cigarette group (24), and simultaneously checking the cigarettes (10) of each part group (48 to 50; 52 to 54; 67, 68).

5. Process according to claim 4, characterized by forming the cigarette groups (24) in respective pockets (27) of an intermittently rotatable cigarette turret (25), and moving the sensors (11, 12) relative to the cigarettes (10).

6. Process according to claim 5, wherein the cigarettes (10) are arranged in rows within each cigarette group, said process characterized by checking the cigarettes of a cigarette group (24) during stationary phases of the cigarette turret (25) in two successive test stations (38, 39), and checking every second cigarette (10) of the rows (29 to 31) of each cigarette group (24) by means of a test unit (40, 41) having a plurality of sensors (11, 12).

7. Process according to claim 5, characterized by checking a cigarette group (24) during the movement of the cigarette turret (25) in such a way that all the cigarettes (10) of a cigarette group (24), are checked in succession, and moving a test unit (65) having a plurality of sensors (11, 12), in coordination with the path of movement of the cigarette groups (24).

8. Apparatus for checking cigarettes for correct formation at their ends by means of electrooptical sensors, which possess transmitters and receivers, and by means of which a test light beam is directable onto at least one end face of the cigarettes and reflected light is measurable, said apparatus characterized in that a sensor (11, 12) is aligned with the end face (16) of a cigarette (10) to form an acute angle (19) of less than 45° of the test beam relative to the end face (16).

9. Apparatus according to claim 8, characterized in that at least two mutually opposite sensors (11, 12) distributed over the circumference of the cigarette (10) and forming a sensor pair (23), are directed toward the end face (16) of the cigarette (10), the sensors (11, 12) being arranged in a sensor carrier (14) and forming a test unit (13) with said sensor carrier (14).

10. Apparatus according to claim 9, wherein the cigarettes are arranged in oblique rows in each of a plurality of cigarette groups, said apparatus characterized in that, for the checking of a cigarette group (24), several sensor pairs (42 to 45; 62 to 64) are arranged in a test unit (40, 41; 65) parallel to one another and at a distance from one another corresponding to two of said oblique rows (32 to 37) of the cigarettes (10) in a cigarette group (24).

11. Apparatus according to claim 10, characterized in that the cigarette groups are transportable in respective pockets (27) of an intermittently rotatable cigarette turret (25), and further comprising two successive test units for checking the cigarette groups in each of two successive test stations during stationary phases of the cigarette turret (25), and means for moving said test unit (40, 41) past the end faces (16) of the cigarettes (10) in such a way that the sensors (42, 45) of each test unit (40, 41) are moved to and fro parallel to the alignment of said oblique rows (32 to 37).

12. Apparatus according to claim 11, wherein the cigarettes of each cigarette group are arranged in part groups, said apparatus characterized in that each test unit (40, 41) has four sensor pairs (42 to 45) for checking the cigarettes (10) of said part groups (48 to 50; 52 to 54).

13. Apparatus according to claim 11, further comprising a rack mechanism (56) for longitudinally displacing each test unit in a plane parallel to the end faces (16) of the cigarettes (10).

14. Apparatus according to claim 11, further comprising, for checking the cigarettes (10) in the pockets (27) during the rotational movement of the cigarette turret (25), means for moving the sensor pairs (62 to 64) of each test unit (65) axially transversely relative to the longitudinal axes of the cigarettes (10).

15. Apparatus according to claim 14, characterized in that each test unit (65) has sensor pairs (62 to 64) for checking the cigarettes (10) of part groups (67, 68) of each cigarette group.

16. Apparatus according to claim 10, characterized in that the cigarette groups are transportable in respective pockets of an intermittently rotatable cigarette turret and in that each cigarette group is made up of two part groups and further comprising a pivoting mechanism for moving the test unit biaxially in a plane parallel to the end faces of the cigarettes for checking each said part group of the cigarette group one after the other in two successive steps.

* * * * *